United States Patent [19]

Callender

[11] Patent Number: 4,884,791

[45] Date of Patent: Dec. 5, 1989

[54] WORK SUPPORT STRUCTURE

[76] Inventor: Daryl T. Callender, 1201 Britain Dr., Lawrenceville, Ga. 30245

[21] Appl. No.: 765,602

[22] Filed: Aug. 14, 1985

[51] Int. Cl.[4] ..... B25B 1/02

[52] U.S. Cl. ..... 269/88; 269/296

[58] Field of Search ..... 182/181, 184, 185, 225; 269/41, 43, 88, 97, 98, 296, 299, 127–129, 910

[56] References Cited

U.S. PATENT DOCUMENTS

| | | | |
|---|---|---|---|
| 805,422 | 11/1905 | Hogan | 269/41 |
| 1,408,675 | 3/1922 | Wimberg | 269/296 |
| 1,553,045 | 9/1925 | Jones | 182/184 |
| 1,687,195 | 10/1928 | Carroll | 269/129 |
| 1,838,151 | 12/1931 | Penote | 182/181 |
| 3,843.110 | 10/1974 | Smith | 269/296 |
| 4,036,466 | 7/1977 | Van Meter | 182/184 |
| 4,095.778 | 6/1978 | Wing | 269/71 |

*Primary Examiner*—Robert C. Watson

*Attorney, Agent, or Firm*—Warren D. Flackbert

[57] ABSTRACT

A work support structure characterized by a leg supported spine which carries spaced apart laterally extending work support sections and, if desired, a work platform. The length of the spine and the length of the work support sections dictate the size of the overall work support area. The legs are vertically adjustable and accommodate variations or any unevenness in the support surface (flooring or terrain) on which the structure rests. A locking arrangement secures each of the work support sections at a preselected location.

3 Claims, 1 Drawing Sheet

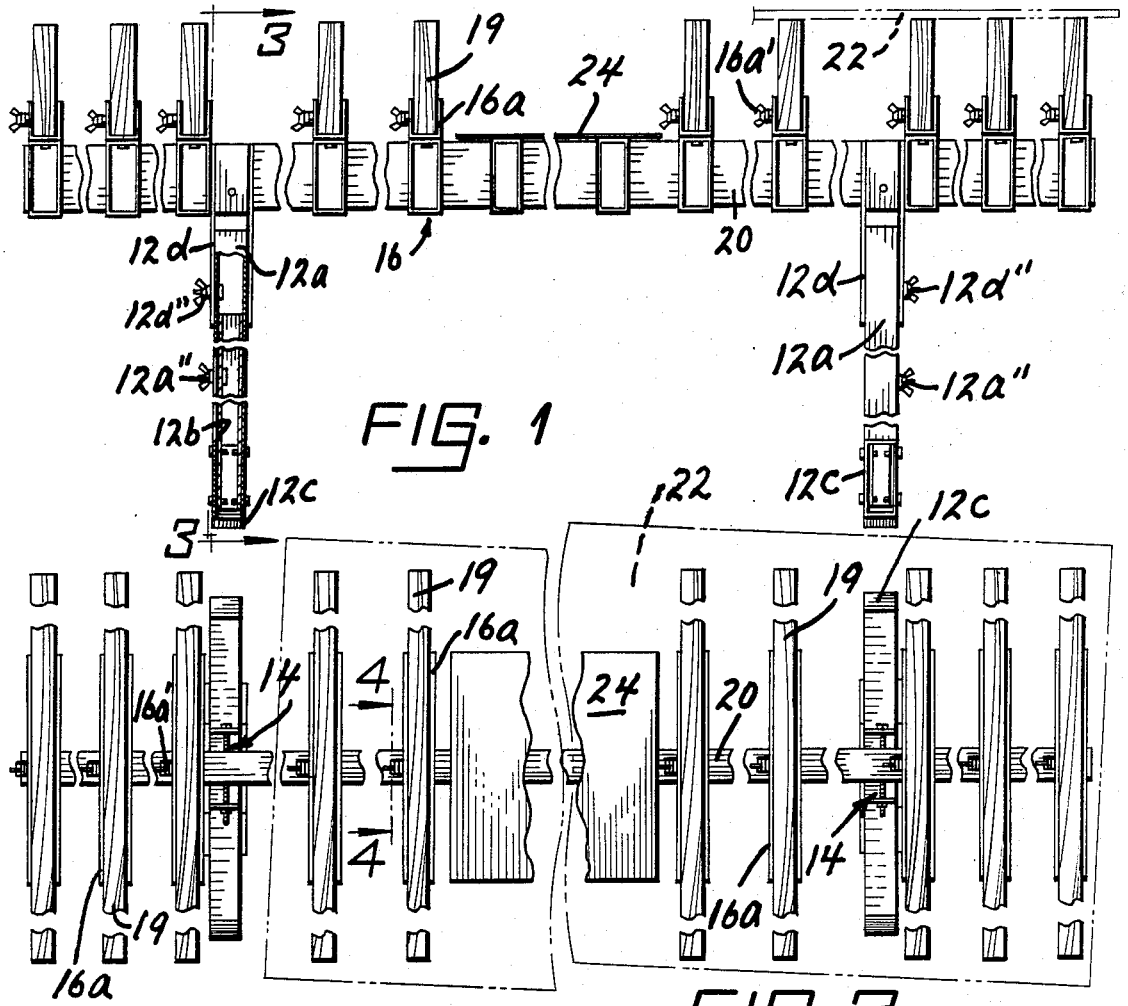
FIG. 1
FIG. 2
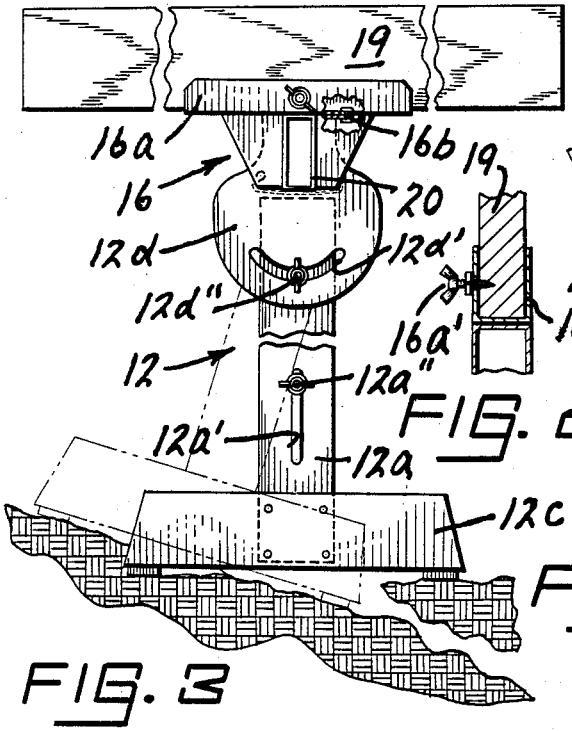
FIG. 3
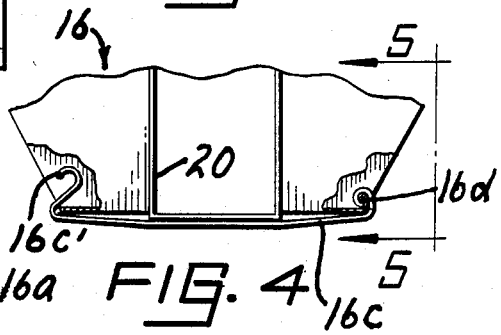
FIG. 4
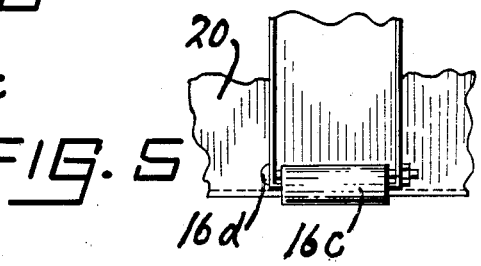
FIG. 5
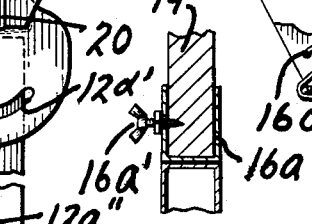
FIG. 6

WORK SUPPORT STRUCTURE

As is known, the need for adequate work support surfaces is widespread, as, for example, in the instance of a carpenter who requires the availability of such at a remote location, as a building site. A particular demand arises where the fitting and/or customizing of large area wallboard or paneling is required, i.e. a structure onto which such wallboard or paneling can be easily placed and readied for installation.

The invention presents a work support structure which can (1) assume a variety of overall lengths, depending upon the length of a centrally disposed spine; (2) be modified in a lateral direction with respect to the spine to accommodate any particular need; (3) be adapted for use on uneven flooring or terrain; (4) readily afford a specialized work area or areas for customized operations; and, (5) be easily moved to various sites.

The preceding is accomplished through the use of upstanding support legs or stands which receive a longitudinally extending spine, as a hollow metal shaft or wooden stock. A series of laterally extending side saddles are placed on the spine in a spaced apart relationship and maintained at each location by a pivotal positive acting saddle clip. Each side saddle, in turn, includes a channel for receiving a removable wooden 2×4 section, for example, the latter typically being retained in position by a wing nut-bolt assembly. The top edge surface of each length of section serves, in combination with the remaining sections, to support work under process, as the aforementioned wallboard or paneling.

In order to provide further versatility, side saddles may be employed to position a separate receiving platform(s), as for a miter saw, for example, i.e. no wooden section receiving channels are provided but, instead, a flat surface. Additionally, the support legs or stands for the structure are arranged to accommodate variations in flooring or terrain, being angularly movable and, thereafter, fixed at a desired position. The preceding permits the presentation of a generally horizontal area for receiving a workpiece.

In any event, a better understanding of the present invention will become more apparent from the following description, taken in conjunction with the accompanying drawing, wherein FIG. 1 is a view in side elevation, partly fragmentary, showing a work support structure in accordance with the teachings of the present invention;

FIG. 2 is a top plan view of the invention, also partly fragmentary, where paneling under processing is shown in phantom;

FIG. 3 is a view in end elevation of the instant work support structure, taken at line 3—3 on FIG. 1 and looking in the direction of the arrows;

FIG. 4 is a view in elevation of a side saddle employed herein, partly fragmentary, detailing the saddle clip, and taken at line 4—4 on FIG. 2 and looking in the direction of the arrows;

FIG. 5 is another view in elevation further detailing the saddle clip, in this instance, however, taken at line 5—5 on FIG. 4 and looking in the direction of the arrows; and, FIG. 6 is a detailed view in vertical section showing a typical arrangement for fastening a lateral wooden section into position within the side saddle receiving channel.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIGS. 1, 2 and 3, the work support structure presented by the invention includes legs or stands 12 each defined by an upstanding outer member **12*a* selectively movable with respect to an upstanding inner member 12*b* (see FIG. 1), a base 12*c*, and spaced apart guide members 12*d* through which a spine 20 extends, the assembly being secured by a bolt-nut-web arrangement 14 (see FIG. 2**).

Movement of the outer member **12*a* achieves height adjustment between the spine 20 and the base 12*c*, where longitudinal slot 12*a*′, with an associated bolt-wing nut assembly 12*a*″, serves positive vertical height adjustment. One of the guide members 12*d* includes an arcuate slot 12*d*′, with an associated bolt-wing nut assembly 12*d*″ serving selective and positive angular placement of the upstanding outer and inner members 12*a*–12*b* together with the base 12*c* (as from the solid to the broken line positions of FIG. 3**). In other words, uneven flooring or terrain on which the structure rests is accommodated.

A series of spaced apart side saddles 16 are disposed along the spine 20, bearing a lateral or transverse relationship therewith. As particularly evident in FIG. 3, the side saddles 16 each include a cut-out portion through which the spine 20 extends and a channel **16*a* secured thereto, as by a fastener(s) 16*b*. Each channel 16*a* is adapted to receive a wooden work support section 19, such as a 2×4 of any desired length, where such is positively positioned by means of a wing nut-bolt combination 16*a*′ (see FIG. 6**).

In order to maintain each side saddle 16 at a preselected location along the spine 20, a saddle clip **16*c* is provided (see FIGS. 4 and 5). In this connection, the saddle clip 16*c* is pivotal on axle 16*d* located at the bottom wall of one side of the side saddle 16 and extends beneath the bottom surface of the spine 20, where a hooked end portion 16*c*′ is adapted to be snapped over the bottom wall of the other side of the side saddle 16 (particularly apparent in FIG. 4**).

When the support structure is erected, the work, such as wallboard or paneling 22 (shown in phantom in FIGS. 1 and 2), is readily positioned on the top edge surfaces of the work support sections 19 for dimensioning or the like. The length of the spine 20 combined with the length of the work support sections 19 afford a significant area for work support and at any desired location.

In the instance where a specialized work area is desired, as for miter saw placement, the channel **16*a* on several adjacent side saddles 16 is omitted and a work shelf 24 substituted (see FIGS. 1 and 2**). Thus, the instant work support structure presents a further end usage.

It should be evident from the preceding that the work support structure of the invention serves importance in providing a convenient at site workpiece/work receiving area, particularly where the workpiece is sheet material, such as wallboard or paneling Added features include the adaptability for presenting a small work platform. As also apparent, the invention readily accommodates variations or unevenness in flooring or the terrain on which the structure rests. The work/workpiece receiving area is variable in overall size, as desired, being dependent upon the length of the spine and the length of the laterally extending work support sections.

The above-described work support structure is susceptible to various changes within the spirit of the invention including, for example, proportioning; the precise shape, in cross-section, of the spine and the lateral work support sections; the material from which these components are fabricated; the precise securement and locating arrangements; and, the like. Thus, the preceding should be considered illustrative and not as limiting the scope of the following claims:

I claim:

1. A work support structure comprising an elongated spine member, legs supporting said elongated spine member, a series of support sections mounted at preselected locations along the longitudinal axis of said elongated spine member, each of said support sections including a saddle through which said elongated spine member extends in a saddle stabilizing relationship, work support members, and a channel mounted on each of said saddles receiving one of said work support members, where said work support members extend outwardly from each side of said elongated spine member, where fastening means selectively position said saddles along said longitudinal axis of said elongated spine member, where the upper surfaces of said work support members combine in a work receiving relationship, and where said fastening means is a pivotal snap clip mounted on said saddles in an underlying relationship with said elongated spine member.

2. A work support structure comprising an elongated spine member, legs supporting said elongated spine member, a series of support sections mounted at preselected locations along the longitudinal axis of said elongated spine member, each of said support sections including a saddle through which said elongated spine member extends in a saddle stabilizing relationship, work support members, and a channel mounted on each of said saddles receiving one of said work support members, where said work support members extend outwardly from each side of said elongated spine member, where fastening means selectively position said saddles along said longitudinal axis of said elongated spine member, where the upper surfaces of said work support members combine in a work receiving relationship, and where said legs are pivotal to maintain said elongated spine member in a generally horizontal plane.

3. A work support structure comprising an elongated spine member, legs supporting said elongated spine member, a series of support sections mounted at preselected locations along the longitudinal axis of said elongated spine member, each of said support sections including a saddle through which said elongated spine member extends in a saddle stabilizing relationship, work support members, and a channel mounted on each of said saddles receiving one of said work support members, where said work support members extend outwardly from each side of said elongated spine member, where fastening means selectively position said saddles along said longitudinal axis of said elongated spine member, where the upper surfaces of said work support members combine in a work receiving relationship, and where certain of said saddles selectively mount an auxiliary work receiving platform.

* * * * *